United States Patent [19]

Lapp

[11] 3,952,516

[45] Apr. 27, 1976

[54] HYDRAULIC PRESSURE AMPLIFIER

[76] Inventor: Ellsworth W. Lapp, Lapp Engineering, c/o Kinroth & Son Mfg. Co., 3423 Lonergan Drive, Rockford, Ill. 61105

[22] Filed: May 7, 1975

[21] Appl. No.: 575,187

[52] U.S. Cl. ..... 60/477; 60/486; 60/DIG. 10

[51] Int. Cl.[2] ..... F15B 15/18

[58] Field of Search ..... 60/477, 486, DIG. 10

[56] References Cited

UNITED STATES PATENTS

| | | | |
|---|---|---|---|
| 2,329,709 | 9/1943 | Fischer | 60/DIG. 10 |
| 2,768,500 | 10/1956 | Tyler | 60/406 |
| 3,772,889 | 11/1973 | Mason et al. | 60/477 X |

*Primary Examiner*—Edgar W. Geoghegan
*Attorney, Agent, or Firm*—Wolfe, Hubbard, Leydig, Voit & Osann, Ltd.

[57] ABSTRACT

A hydraulic pressure amplifier with a scavenging pump operable to establish a negative return line pressure to effect a positive and rapid return of the rod of a one-way hydraulic actuator and thereby eliminate the necessity of third line-type systems that depend on gravity and/or spring-loaded actuators to return the hydraulic fluid to the tank.

3 Claims, 2 Drawing Figures

14
16
15
19
17
43
39
41
46
45
40
44
37
21
36
47
34
20
33
35
13
31
30
29
27
28
23
26
24
25
10
P
11

HYDRAULIC PRESSURE AMPLIFIER

BACKGROUND OF THE INVENTION

This invention relates to a hydraulic pressure amplifier or intensifier which receives pressure fluid from a low pressure pump and increases the pressure of the fluid automatically to a desired magnitude before delivering the fluid to a utilization device. One specific type of utilization device which the amplifier may serve is a single-acting hydraulic actuator having a rod which is advanced in one direction when pressure fluid is admitted into one end of a cylinder. When the pressure fluid is released from the cylinder, a spring returns the rod in the opposite direction.

SUMMARY OF THE INVENTION

The general aim of the present invention is to provide a comparatively simple and compact hydraulic pressure amplifier uniquely equipped with a scavenging pump which establishes a negative return line pressure and which, when the amplifier is used with a single-acting actuator, positively induces a negative return line pressure and effects a faster and more positive return of the actuator rod to its fully retracted position.

A more detailed object is to provide a hydraulic pressure amplifier having a single rotary hydraulic motor which is used both for driving the scavenging pump and for driving a high pressure pump for boosting the pressure of the low pressure fluid.

These and other objects and advantages of the present invention will become more apparent from the following detailed description when taken in conjunction with the accompanying drawings.

DETAILED DESCRIPTION OF THE PREFERRED EMBODIMENT

Figure 1:
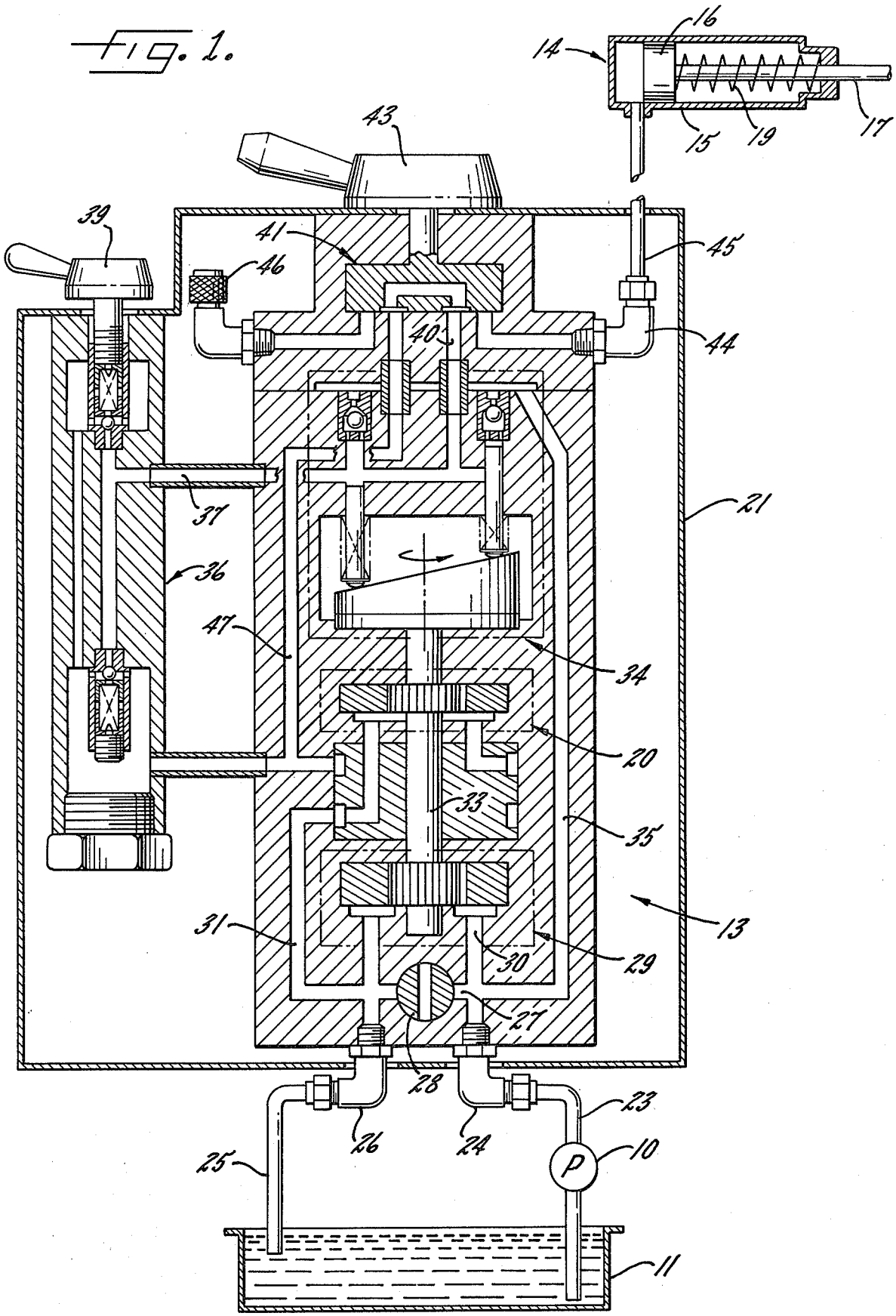
FIG. 1 is a partially structural and partially schematic view showing a hydraulic system equipped with a new and improved hydraulic pressure amplifier incorporating the unique features of the invention.

The invention is shown in the drawings in conjunction with a hydraulic system in which a low pressure pump 10 delivers pressure fluid from a reservoir 11 to a hydraulic pressure amplifier 13. The latter, in turn, boosts the pressure of the fluid automatically to a desired level and is selectively operable to deliver the high pressure fluid to a utilization device 14. Herein, the utilization device is shown as being a reciprocating single-acting hydraulic actuator having a cylinder 15 which slidably receives a piston 16 and a rod 17. Advancement of the rod is effected when pressure fluid is admitted into the base end of the cylinder while return of the rod is effected by a spring 19 when the pressure fluid is released from the base end of the cylinder.

A typical application of the hydraulic actuator 14 is for operating a cutting or crimping tool which is manuevered by a worker standing in the bucket of a utility truck boom adapted to be operated by the pump 10. The latter is driven by the truck and, in one particular example, is capable of delivering fluid at an appropriate flow rate and at a maximum pressure of 2500 p.s.i. In most instances, however, it may be necessary to supply fluid to the actuator 14 at a pressure level of between 10,000 and 12,000 p.s.i. The amplifier 13, therefore, may be connected between the pump 10 and the actuator 14 to boost the pressure to the required value. The amplifier may be carried in the boom bucket and may be connected to the pump 10 by plain rather than high pressure wire braid hoses since only low pressure fluid is delivered to the amplifier. As a result, there is no danger of the connecting hoses presenting an electrical hazard by acting as a ground if the operator should happen to contact high tension wires.

When the amplifier 13 delivers high pressure fluid to the cylinder 15, the rod 17 is rapidly and positively advanced to actuate the tool at a preselected high pressure. In accordance with the present invention, the amplifier is provided with a novel scavenging pump 20 which is selectively operable to pump fluid from the base end of the cylinder during return of the rod and thereby effect a faster and more positive return than is the case when the spring 19 acts alone to force the fluid out of the cylinder and overcome the back pressure inherently present in the line 25. Moreover, the scavenging pump is arranged compactly with the other elements of the amplifier so as to enable construction of the amplifier as a compact and easily portable unit.

Figure 2:
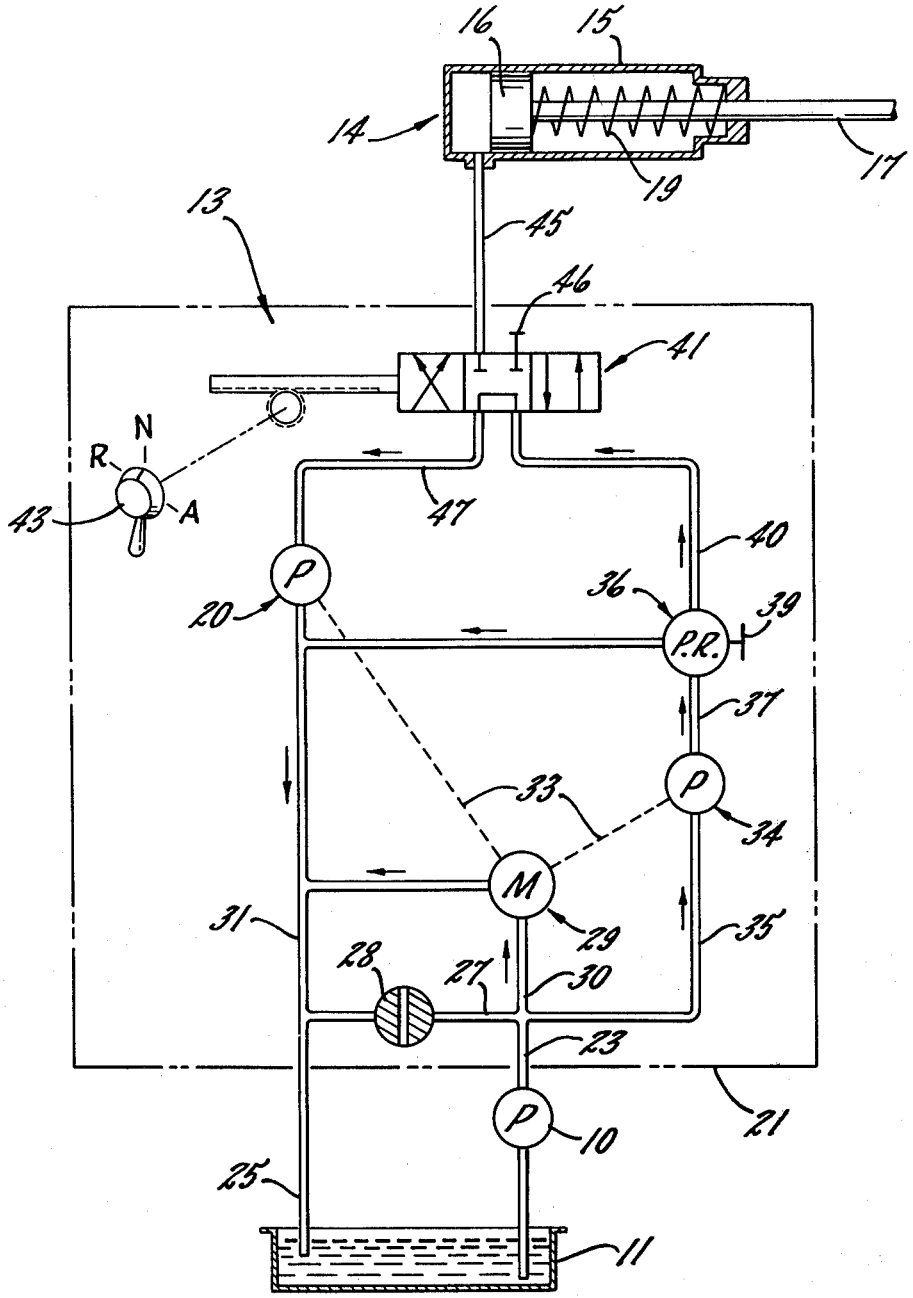
FIG. 2 is a fluid circuit diagram of the system shown in FIG. 1.

More specifically, the amplifier 13 includes a box-like case 21 made of sheet metal and enclosing the various operating elements of the amplifier. A flexible line 23 leading from the outlet of the low pressure pump 10 is adapted to be connected to a fitting 24 (FIG. 1) adjacent the lower end of the case while a flexible drain line 25 is adapted to be connected to a similar fitting 26 and leads to the reservoir 11. Within the case are various fluid-conducting passages, conduits and bores which will be referred to collectively as "lines". One such line 27 is adapted to communicate with the lines 23 and 25 and includes a rotary on-off valve 28. When the valve is located in its "on" position as shown in FIGS. 1 and 2, the output of the low pressure pump 10 is delivered to the operating elements of the amplifier 13. If the valve is turned 90 degrees to its "off" position, pressure fluid from the line 23 simply returns to the reservoir 11 through the lines 27 and 25 and thus bypasses the operating elements of the amplifier. The valve may be turned manually by means of an operating lever (not shown) on the outside of the case 21.

When the valve 28 is "on", part of the output of the low pressure pump 10 is directed to the inlet of a hydraulic motor 29 through a line 30. In this particular instance, the motor 29 is the rotary type and its outlet communicates with the drain line 25 by way of a return line 31 within the case 21. When the motor is supplied with pressure fluid, its rotor turns a shaft 33 which extends vertically within the case 21. The shaft is connected to rotate the rotor of the scavenging pump 20 which, in this instance, also is of the rotary type. In addition, the shaft is connected to rotate the swash plate of an axial plunger pump 34 capable of developing continuous pressures as high as 12,000 p.s.i. The rotors of the scavenging pump 20 and the motor 29 and the swash plate of the high pressure pump 34 are all coaxial with the shaft 33.

Part of the output of the low pressure pump 10 is delivered to the inlet of the high pressure pump 34 through a line 35 and appropriate inlet check valves (not shown). After being pressurized by the pump 34, such fluid is delivered to an adjustable pressure relief valve 36 through a line 37. The setting of the pressure relief valve is infinitely variable between inlet line pressure and 12,000 p.s.i. and may be changed by adjusting a rotary knob 39 on the upper side of the case 21. Fluid at the selected pressure is delivered from the relief valve 36 through a line 40 while excess fluid is directed from the relief valve to the return line 31.

The line 40 leading from the pressure relief valve 36 communicates with a four-way, three-position rotary selector valve 41 which may be adjusted between "advance", "neutral" and "retract" positions by turning a detented knob 43 on the upper side of the case 21. When the valve 41 is in its "advance" position, fluid from the line 40 is admitted into the base end of the cylinder 15 through a fitting 44 and a flexible line 45 to advance the rod 17. Shafting of the selector valve to its centered "neutral" position shown in FIG. 2 blocks the flow of fluid to and from the cylinder so as to keep the rod in a set position, the fluid in the line 40 flowing through the valve and being directed to the return line 31. When the selector valve is shifted to its "retract" position, flow of fluid from the line 40 is blocked by a normally closed quick connect coupling 46 and, at the same time, communication is established between the base end of the cylinder 15 and the return line 31 to allow fluid to escape from the cylinder so that the spring 19 may retract the rod 17.

In keeping with the invention, a line 47 establishes communication between the base end of the cylinder 15 and the inlet of the scavenging pump 20 when the selector valve 41 is in its "retract" position. As a result, the power-driven scavenging pump positively pumps the fluid out of the cylinder and delivers such fluid to the return line 31, the latter communicating with the outlet of the scavenging pump. Because the scavenging pump produces a negative pressure in the lines 45 and 47 and draws the fluid out of the cylinder with a positive action, the pressure in the cylinder is rapidly reduced and thus the rod 17 is retracted much quicker and with a more positive motion than is the case when the spring 19 alone is relied upon to force the fluid out of the cylinder and overcome the back pressure inherent in the line 25. Thus, the time required for the rod to return is significantly reduced and it is not necessary to provide a so-called "third line" system.

From the foregoing, it will be apparent that the present invention brings to the art a new and improved hydraulic amplifier 13 having a unique scavenging pump 20 for establishing a negative return line pressure from the single acting, high pressure actuator 14. By virtue of employing a rotary scavenging pump 20, a rotary motor 29 and a high pressure pump 34 with a rotary swash plate, the amplifier may be compactly constructed and its elements may be incorporated in a relatively small case 21. By connecting a flexible line between the coupling 46 and the rod end of the cylinder 15, the amplifier may be used to supply high pressure fluid to a double acting actuator and thus is capable of serving both single and double acting actuators. The four-way valve 41 is appropriate for both single and double acting systems.

What is claimed is:

1. A hydraulic amplifier operable to receive low pressure fluid from a low pressure pump, to increase the pressure of said fluid, and to deliver the high pressure fluid to a utilization device, said amplifier being selectively operable to conduct fluid from said utilization device to a reservoir associated with said pump, said amplifier comprising, in combination, a hydraulic motor connected to receive and be actuated by part of the low pressure fluid delivered from said pump, a high pressure pump connected to receive part of the low pressure fluid delivered from said low pressure pump and operable when driven to increase the pressure of such fluid, means connecting said high pressure pump with said motor and operable to drive said high pressure pump when said motor is actuated, a scavenging pump connected to be driven by said motor and having an outlet adapted to communicate with said reservoir, and valve means selectively movable between a first position connecting the outlet of said high pressure pump with said utilization device and a second position connecting the inlet of said scavenging pump with said utilization device whereby high pressure fluid is delivered to said utilization device by said high pressure pump when said valve means are in said first position and is pumped from said utilization device and delivered to said reservoir by said scavenging pump when said valve means are in said second position.

2. A hydraulic amplifier as defined in claim 1 further including a box-like case enclosing said motor, said high pressure pump and said scavenging pump, said motor and said scavenging pump having rotatable rotors and said high pressure pump having a rotatable swash plate, said connecting means comprising a rotatable shaft connected to and coaxial with said rotors and said swash plate.

3. A hydraulic amplifier as defined in claim 2 further including a variable pressure relief valve disposed within said case and operable to regulate the pressure of the fluid conducted from said high pressure pump to said valve means.

* * * * *